US011705613B2

(12) United States Patent
Metzner et al.

(10) Patent No.: US 11,705,613 B2
(45) Date of Patent: Jul. 18, 2023

(54) WAVEGUIDE STRUCTURE COMPRISING FIRST AND SECOND WAVEGUIDE SECTIONS CONNECTED TO EACH OTHER THROUGH A FIXED CONNECTOR

(71) Applicant: Schleifring GmbH, Fürstenfeldbruck (DE)

(72) Inventors: Iris Metzner, Neubiberg (DE); Holger Steffens, Munich (DE)

(73) Assignee: SCHLEIFRING GmbH, Fürstenfeldbruck (DE)

( * ) Notice: Subject to any disclaimer, the term of this patent is extended or adjusted under 35 U.S.C. 154(b) by 0 days.

(21) Appl. No.: 17/897,537

(22) Filed: Aug. 29, 2022

(65) Prior Publication Data

US 2022/0416381 A1 Dec. 29, 2022

Related U.S. Application Data

(63) Continuation of application No. PCT/EP2021/056243, filed on Mar. 11, 2021.

(30) Foreign Application Priority Data

Mar. 11, 2020 (EP) ..... 20162482

(51) Int. Cl.
*H01P 5/02* (2006.01)
*H01P 1/04* (2006.01)
(Continued)

(52) U.S. Cl.
CPC ..... *H01P 5/02* (2013.01); *H01P 1/047* (2013.01); *H01P 3/026* (2013.01); *H01P 3/16* (2013.01); *H01P 5/028* (2013.01); *H01P 5/107* (2013.01)

(58) Field of Classification Search
CPC .... H01P 5/028; H01P 5/02; H01P 3/26; H01P 3/026
(Continued)

(56) References Cited

U.S. PATENT DOCUMENTS 5,530,422 A 6/1996 Harrison
2006/0145778 A1 7/2006 Pleva et al.
(Continued)

FOREIGN PATENT DOCUMENTS

CN 104170076 A 11/2014
GB 2497982 A 7/2013
(Continued)

OTHER PUBLICATIONS

PCT International Search Report and Written Opinion, PCT/EP2021/056243, dated Jun. 10, 2021, 16 pages.
(Continued)

*Primary Examiner* — Benny T Lee
(74) *Attorney, Agent, or Firm* — Quarles & Brady LLP; Yakov S. Sidorin

(57) ABSTRACT

A waveguide structure includes a first waveguide section mechanically and electrically connected by a fixed connector to a second waveguide section. The waveguide sections include a dielectric material with a ground layer and a conductor structure with a pair of elongate conductors. The fixed connector includes a dielectric material with a pair of contact pads insulated from a ground layer. The fixed connector is attached by its top side to the bottom sides of interface sections of the waveguides sections forming a ground contact. The interface sections each comprise an intermediate conductor from each of the elongate conductors at the top side to the bottom side of the dielectric material. The intermediate conductors are connected via the contact pads.

21 Claims, 14 Drawing Sheets

(51) Int. Cl.
*H01P 3/02* (2006.01)
*H01P 3/16* (2006.01)
*H01P 5/107* (2006.01)

(58) Field of Classification Search
USPC ..... 333/24 R, 260
See application file for complete search history.

(56) References Cited

U.S. PATENT DOCUMENTS

| | | | | |
|---|---|---|---|---|
| 2008/0191818 | A1* | 8/2008 | Lee et al. | H01P 5/028 333/247 |
| 2011/0037531 | A1 | 2/2011 | Hasselblad et al. | |
| 2012/0020416 | A1* | 1/2012 | Shimura et al. | H01B 7/0838 375/257 |
| 2012/0182093 | A1 | 7/2012 | Vickes et al. | |
| 2014/0179127 | A1* | 6/2014 | Denis et al. | H05K 1/0237 439/43 |
| 2015/0349398 | A1 | 12/2015 | Uemichi | |

FOREIGN PATENT DOCUMENTS

| | | | |
|---|---|---|---|
| JP | 2015076836 | A | 4/2015 |
| WO | 9829919 | A1 | 7/1998 |
| WO | 0184665 | A1 | 11/2001 |
| WO | 2018221485 | A1 | 12/2018 |

OTHER PUBLICATIONS

European Patent Office, Extended Search Report, Application No. 21162121.4, dated Jul. 20, 2021, 6 pages.
Search report issued in related Chinese patent application No. 2021800087249, dated Jan. 17, 2023, 3 pages.

* cited by examiner

WAVEGUIDE STRUCTURE COMPRISING FIRST AND SECOND WAVEGUIDE SECTIONS CONNECTED TO EACH OTHER THROUGH A FIXED CONNECTOR

CROSS-REFERENCE TO RELATED APPLICATIONS

This US Patent Application is a continuation of the pending PCT/EP2021/056243 filed on Mar. 11, 2021 and now published as WO 2021/180876, which in turn claims priority from the European Patent Application EP 20162482.2 filed on Mar. 11, 2020. The disclosure of each of the above-identified patent applications is incorporated herein by reference.

FIELD OF THE INVENTION

The invention relates to waveguide structures formed by interconnected multiple waveguide sections. These waveguide structures may be used for guiding electromagnetic waves specifically in rotating contactless data links. These waveguide structures include a layer of dielectric material further having at one side a ground layer and opposing thereto a conductor structure of electrically conductive material. The conductor structure may be a uniform line having a predetermined characteristic impedance or a structured pattern which may have a filtering characteristic.

DESCRIPTION OF THE RELATED ART

In rotating contactless data links, waveguide structures are used for guiding RF signals. These waveguide structures may include striplines, microstrips or similar structures for guiding electromagnetic waves. They include a dielectric material further having at one side a conductive ground layer and opposing thereto a conductor structure of electrically conductive material, mostly a thin copper layer, which may be galvanized. The waveguide structures are like elongate PCBs (Printed Circuit Boards) and are often manufactured as such. The conductor structure may be a uniform line having a predetermined characteristic impedance or a structured pattern line which may have a filtering characteristic.

A microstrip conductor is disclosed in U.S. Pat. No. 5,530,422 A. A meander shaped conductor structure which offers better coupling and RF noise suppression is disclosed in document EP 1 012 899 B1. The structured pattern line disclosed therein has a constant characteristic impedance for lower frequencies e.g., less than 5 GHz and a high suppression of higher frequencies.

In large devices like CT (Computed Tomography) scanners, a waveguide structure may have a total length up to 5 m adapted to the outer circumference of the rotating part of the gantry. Normal PCBs are comparatively small and manufacturing waveguide structures with a length of up to 5 m needs special manufacturing processes which are extremely expensive.

Starting from normal PCBs, the manufacturing machines may be increased in size. Further, it may be possible to wind the PCBs and materials as they are long but comparatively narrow and must have some flexibility to form a circle in the later application.

SUMMARY OF THE INVENTION

The problem to be solved by the invention is to provide larger waveguide structures for lower costs while maintaining good RF characteristics.

Solutions to the problem and further improvements are described below.

In an embodiment, multiple waveguide sections are joined together to form a larger waveguide structure by at least one fixed connector. Although it may be more straightforward to use standard PCB connectors, which may be connected and disconnected, fixed connectors, which e.g., may be soldered, welded, have a conductive adhesive, or a galvanized contact, between the PCBs have shown to offer significant advantages. Connecting waveguide sections by such connectors allows to manufacture the waveguide portions like PCBs by normal manufacturing machines and processes. Special interconnections between the waveguide sections are provided to maintain the RF characteristics of the waveguide portions throughout the waveguide structure. The interconnections are designed such as to not extend over the surface of the waveguide sections to avoid interaction with a receiving pickup passing the waveguide structure at a close distance. Further, the interconnections may provide reinforcement to increase the mechanical stability, e.g., to prevent damages during transport and during assembly into a larger slipring body. Such a reinforcement may still have some degree of flexibility and/or be limited in size to give the overall waveguide structure a flexibility to be adapted to a circular body.

The waveguide sections include at least one layer of a dielectric material (an insulating material). They may also include a plurality of dielectric layers. They may be printed circuit boards. There may be conductive layers or layers with conductive structures between the dielectric layers. The waveguide sections may have at one side, here called the "bottom side, of a layer of a dielectric material a conductive ground layer and opposing thereto, here called the "top side", a conductor structure of electrically conductive material. Herein the terms "top side" and "bottom side" are only used for simplifying reference. The embodiments may also be reversed with the bottom side on top or in any other orientation.

The ground layer and/or the conductor structure may include a thin copper layer, which may be galvanized with a high conductivity material like silver or gold.

The conductor structure may include at least one or a pair of elongate conductors, which may be parallel and spaced with a first distance. The conductor structure may be a uniform line or a pair of uniform lines having a predetermined characteristic impedance or a single or a pair of structured pattern lines which may have a filtering characteristic. The predetermined characteristic impedance may be essentially constant over the length of the conductor structure. The characteristic impedance may be a constant value between 1 Ohm and 200 Ohm or between 10 Ohm and 100 Ohm. There may be a single line or a pair of lines, which may be operated differentially. For a larger number of signals, a larger number of lines may be provided. The ground layer and/or the conductor structure may be at outer sides of the dielectric material or embedded into the dielectric material. The ground layer and the conductor structure have at least to be separated by dielectric material. The conductor structures normally are not connected to the ground layer.

The waveguide sections may have the shape of a rectangular plate or arc shaped plate with a thickness of less than 3 mm, 2 mm or 1 mm, depending on the specific implementation They have two opposing ends and two opposing longitudinal sides between the ends. They may also have the shape of a flexible PCB with a thickness of less than 1 mm, 0.5 mm, 0.2 mm, or 0.1 mm. The minimum thickness may be 0.1 mm, 0.2 mm, or 0.25 mm, depending on the specific implementation. The lines may have a linear (straight) shape and in the case of two or more lines, they may be parallel to each other.

The waveguide sections may include an interface section at least one of the two opposing ends. The interface sections may include an intermediate conductor from each of the elongate conductors at the top side to the bottom side of the at least one layer of a dielectric material.

Two elongate conductors (interchangeably referred to herein as elongated conductors) are parallel to one another and may be separated by a distance (at the interface sections) that is larger than the first distance. The first distance is the distance the conductors have over their length and distant from the interface sections. Two intermediate conductors may be connected to the two elongate conductors, which have a distance larger than the first distance.

An x-axis (the longitudinal axis of a waveguide section) is defined along the length of the lines and at the center of the lines in the plane of a waveguide section. A first end and a second end of a waveguide section are spaced in direction of the x-axis.

A y-axis (the transverse axis) is substantially orthogonal (under a 90° angle) to the x-axis in the plane of the waveguide section. A z-axis is orthogonal to the x- and y-axis and protrudes from the plane of the lines to the space above the lines. A first end and a second side of a waveguide section are spaced in direction of the y-axis.

The waveguide sections may have a length (in direction of the longitudinal axis) of less than 100 cm, 80 cm, 50 cm, or 30 cm and a width, which may be smaller than the length of less than 10 cm, 5 cm, 3 cm, 2 cm or 1 cm, depending on the specific implementation. The width may be more than 3 mm or 5 mm. The waveguide sections may be cut from shorter panels which may have lengths of 24", 48", 54", 72" or 84". For all sizes there may be clippings (border areas) of 1" at each side of the panel of usable (printable) size. It may also be possible to use maximum available panel lengths of typically 102" as waveguide section. Depending on the requirement of the design lengths may be up to 2540 mm, 2080 mm, 1770 mm or up to 1320 mm, 1160 mm and 550 mm can be realized or any length below, in practice longer than 300 mm.

The waveguide sections may be either flat or arc-shaped around an axis parallel to the y-axis or the z-axis.

At least one fixed connector may be provided to connect two waveguide sections. Such a fixed connector may be a printed circuit board and includes at least one layer of a dielectric material having a top side, a bottom side, and two opposing ends. The fixed connector may further include at least one contact pad of electrically conductive material on the top side, and a connector ground layer of electrically conductive material on the top side and insulated from the at least one contact pad.

The fixed connector as a printed circuit board may have a length of 7 mm to 18 mm, a width similar in value to the width of the waveguide sections.

The at least one fixed connector may be is attached by the top side thereof to the bottom side of the interface section of a first end of at least one first waveguide and to the bottom side of the interface section of a second end of at least one second waveguide. Further, each of the intermediate conductors of interface sections of the waveguide sections may be connected to a contact pad and are insulated from the ground layer. Consequently, they are also insulated from the connector ground layer. The waveguide sections may be opposing each other and at least one intermediate conductor of a first waveguide section is connected to an opposing intermediate conductor of a second waveguide section by at least one contact pad.

In an embodiment, a waveguide structure may include at least one first waveguide section mechanically and electrically connected by at least one fixed connector to at least one second waveguide section, each of the at least one first and the at least one second waveguide sections may include at least one of:

- at least one layer of a dielectric material having a top side, a bottom side and two opposing ends,
- a ground layer of electrically conductive material on the bottom side,
- at least one conductor structure including at least one of or at least a pair of elongate conductors of electrically conductive material on the top side, the at least one conductor structure being insulated from the ground layer, and
- an interface section at at least one of the two opposing ends the at least one fixed connector may include at least one of:

- at least one layer of a dielectric material having a top side, a bottom side and two opposing ends,
- at least one pair of contact pads of electrically conductive material on the top side, and
- a connector ground layer of electrically conductive material on the top side and insulated from the at least one contact pad, and the at least one fixed connector may be attached by the top side thereof

- to the bottom side of the interface section of a first end of at least one first waveguide, having an electrical contact between the connector ground layer and the ground layer of the at least one first waveguide,
- to the bottom side of the interface section of a second end of at least one second waveguide, having an electrical contact between the connector ground layer and the ground layer of the at least one second waveguide, and the interface sections may include an intermediate conductor from each of the elongate conductors at the top side to the bottom side of the at least one layer of a dielectric material, each of the intermediate conductors being connected to a contact pad and insulated from the ground layer, the at least one first and the at least one second waveguide sections are opposing each other and at least one intermediate conductor of a first waveguide section is connected to an opposing intermediate conductor of a second waveguide section by at the at least one contact pad. In a specific case, the at least one first waveguide section and/or the at least one second waveguide section includes at least one printed circuit board.

In another embodiment, a waveguide structure may include at least one first waveguide section mechanically and electrically connected by at least one fixed connector to at least one second waveguide section, each of the at least one first and the at least one second waveguide sections may include at least one of:

- at least one layer of a dielectric material having a top side, a bottom side and two opposing ends,
- a ground layer of electrically conductive material on the bottom side,
- at least one conductor structure including at least one of or at least a pair of elongate conductors of electrically conductive material on the top side, the at least one conductor structure being insulated from the ground layer, and an interface section at at least one of the two opposing ends the at least one fixed connector may include at least one of:

at least one layer of a dielectric material having a top side, a bottom side and two opposing ends, a connector ground layer and the at least one fixed connector may be attached by the top side thereof to the bottom side of the interface section of a first end of at least one first waveguide, having an electrical contact between the connector ground layer and the ground layer of the at least one first waveguide, to the bottom side of the interface section of a second end of at least one second waveguide, may have an electrical contact between the connector ground layer and the ground layer of the at least one second waveguide, and the interface sections may be connected by a pair of conductive pads, where each of the conductive pads connects each of a pair of elongate conductors of the at least one first waveguide section to each of the corresponding of the elongate conductors of the at least one second waveguide section.

Conductive pads may include at least one of copper, brass, tin, silver or gold. They me be a thin film or layer of such conductive material. The conductive pads may form a corrugation between the waveguide sections. The interface sections may be straight cut ends of the waveguide sections.

In an embodiment, at least one electrical contact is formed by soldering connections, welding connections, conductive adhesive, or galvanized contact. For example, embodiments of the invention provide a waveguide structure in which one of the at least one pair of contact pads of the at least one fixed connector is connected to an intermediate conductor, of corresponding intermediate conductors of the interface sections of the at least one first waveguide section and the at least one second waveguide section, by at least one of soldering connections, welding connections, a conductive adhesive, or a galvanized contact.

BRIEF DESCRIPTION OF THE DRAWINGS

In the following the invention will be described by way of example, without limitation of the general inventive concept, on examples of embodiment with reference to the drawings. Reference is made to the list of reference numerals below, which identifies the components in the figures, where like features are denoted by the same reference labels throughout the drawings and detailed description thereof.

DETAILED DESCRIPTION OF THE INVENTION

Figure 1:
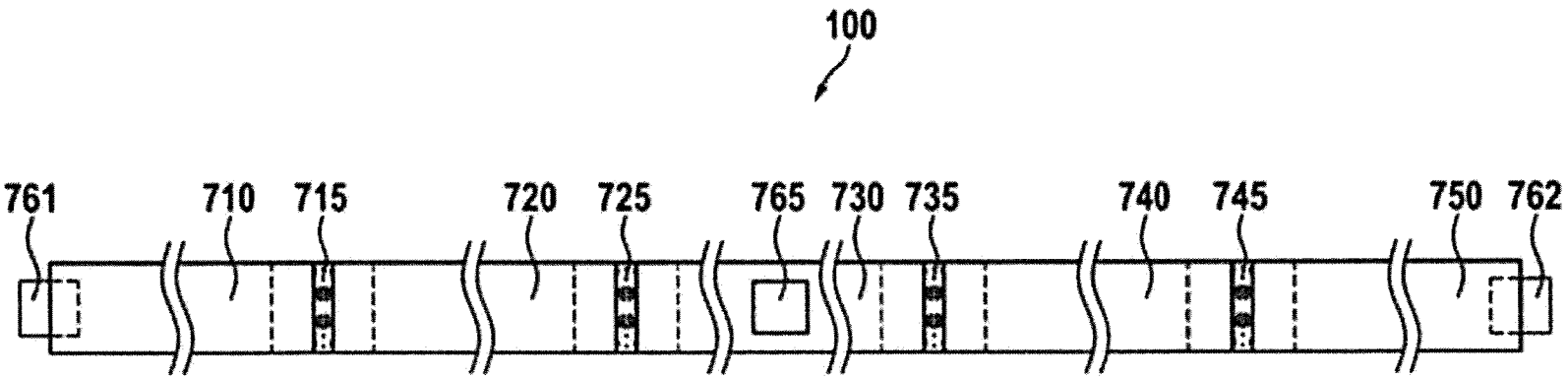
FIG. 1 shows a top view of an embodiment.

In FIG. 1, a top view of an embodiment of a waveguide structure is shown. A plurality of waveguide sections 710, 720, 730, 740, 750 are interconnected by fixed connectors 715, 725, 735, 745. These interconnected waveguide sections form a waveguide structure 100. The waveguide structure 100 may further have at least one termination 761, 762 at at least one of the ends thereof. Further, a signal connector 765 may be provided, which may be at the center of the length of the waveguide structure. Instead of the terminations 761, 762, also a signal connector may be provided. The waveguide structure may have a length up to 2 to 5 m and a width of up to 1 cm, 2 cm or 5 cm. The width may be larger than 5 mm.

The waveguide structure as shown may be mounted to the circumference of a slipring module by adhesives, a layer of adhesive tape or mounting brackets or a combination those.

Figure 2:
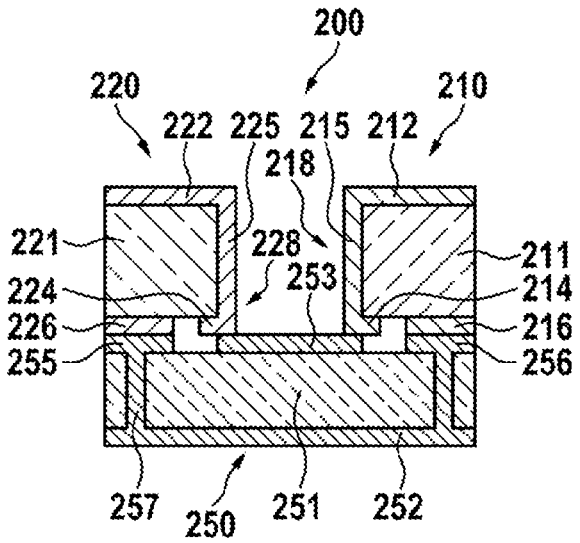
FIG. 2 shows a connection between two waveguide sections.

In FIG. 2, a connection between two waveguide sections in a sectional side view is shown. A waveguide structure section 200 includes a first waveguide section 210 and a second waveguide section 220. The first waveguide section 210 includes a first interface section 218, a first layer of dielectric material 211 having a first elongate conductor 212 on the top thereof and a first ground layer 216 at the bottom thereof. The second waveguide section 220 includes a second interface 228, a second layer of dielectric material 221 having a second elongate conductor 222 on the top thereof and a second ground layer 226 at the bottom thereof.

Further, the first interface section 218 includes a first intermediate conductor 215 which extends from the first elongate conductor 212 down to the bottom side of the first layer of dielectric material. There may be a first contact pad 214 at the bottom of the first layer of dielectric material 211 to simplify contacting with a fixed connector 250. The first contact pad 214 may be connected to the first intermediate conductor 215.

Further, the second interface section 228 includes a second intermediate conductor 225 which extends from the second elongate conductor 222 down to the bottom side of the second layer of dielectric material. There may be a second contact pad 224 at the bottom of the second layer of dielectric material 221 to simplify contacting with a fixed connector. The second contact pad 224 may be connected to the second intermediate conductor 225.

A fixed connector 250 includes a fixed connector dielectric layer 251 which has a connector ground layer 255, 256. The sections of the connector ground layer 255, 256 are electrically connected, for example by a connector ground base layer 252 at the bottom side of the fixed connector dielectric layer and by additional vias or through-holes 257. Further, the fixed connector further includes at least one contact pad 253 on the top side thereof, which is electrically insulated from the ground layer. The fixed connector may have the same width as the first and second waveguide sections, but may be much shorter, e.g., up to 5 cm or up to 10 cm. The thickness of the fixed connector and/or of the waveguide sections may be more than 0.5 mm and up to 2 mm, 3 mm or 5 mm. The fixed connector and/or of the waveguide sections may include a fiber reinforced polymer for increased mechanical stability and may be a PCB.

To provide an electrical connection between the first waveguide section 210 and the second waveguide section 220, the fixed connector 250 is soldered to these waveguide sections. For ground connection, the connector ground layer 255, 256 is soldered to the ground layers 216, 226 of first and second waveguide sections. Further, the contact pad 253 is soldered to the first and second intermediate conductors 215, 225, and/or to first and second contact pads 214, 224. The first and second contact pads 214, 224 provide a better soldering over a larger surface, but may also be omitted if the intermediate conductors reach close to the contact pad 253. Instead of soldering, the contact may be established by welding, conductive adhesive or anodizing, or a combination thereof. In addition, there may be rivets and/or screws for mechanical fixation of at least one waveguide section to a fixed connector.

Figure 3:
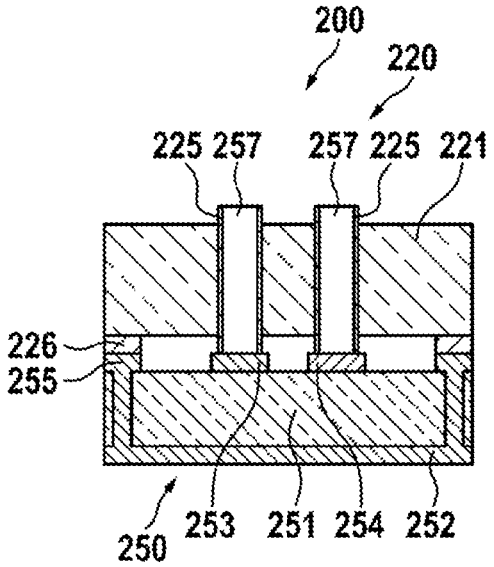
FIG. 3 shows a front view to the second interface section of FIG. 2.
Figure 4:
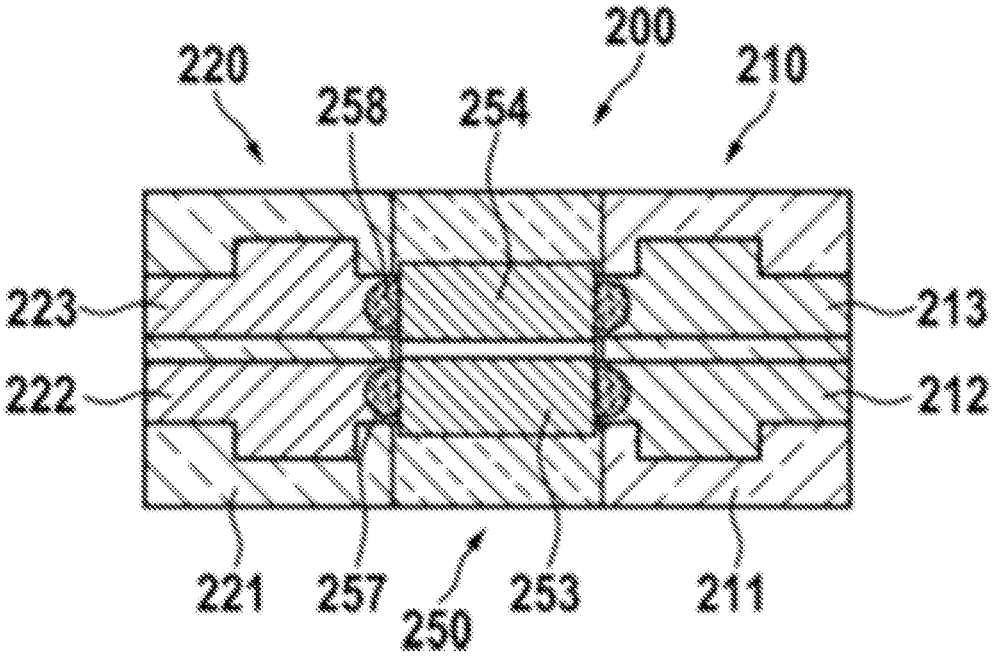
FIG. 4 shows a top view of the interconnected waveguide sections.

In FIG. 3, a front view onto the second interface section of FIG. 2 is shown while FIG. 4 illustrates a corresponding top view. These FIGS. 2, 3, 4 depict a dual conductor system with two symmetrically arranged conductors at the waveguide sections. In a single conductor system, there would only be one second elongate conductor 222. In this dual conductor system of FIGS. 2, 3, and 4, there is a pair of second elongate conductors 222, 223. For connecting these conductors, the fixed connector 250 includes a pair of contact pads 253, 254 (see, for example, FIG. 3). For a single ended system, only one contact 253 would be sufficient to contact second elongate conductor 222. Further, a specific embodiment of the second intermediate conductor 225 is shown, which is the same on both sides of the second elongate conductors 222, 223. Such an intermediate conductor 225 may be a planar strip of electrically conductor material but is also may be a via or half a via or an edge metallization. The intermediate conductor 225 may also be a rivet, or a wire. The distance between the intermediate conductors is essentially equal to the first distance separating the pair of elongate conductors 212, 213 on the first waveguide section 210. In printed circuit technology, a via normally is a hole drilled through the insulating layer and metallized on the inner surface thereof to provide an electrical contact between both sides of the dielectric layer. Such vias can be manufactured easily and cost-effective.

In FIG. 4, a top view of the interconnected waveguide sections is shown. Here, the pairs of elongate conductors 222, 223 on the second waveguide section are shown in more detail, as is the pair of elongate conductors 212, 213 on the first waveguide section 210. Here, the vias 257 include some solder (solder spots 258) to provide a contact to the contact pads 253, 254 of the fixed connector 250. There is a gap of the first distance between the pair of elongate conductors 212, 213 on the first waveguide section 210. The same gap is between the pairs of elongate conductors 222, 223 on the second waveguide section. The first distance 134 is further explained in reference to FIG. 26.

Figure 5:
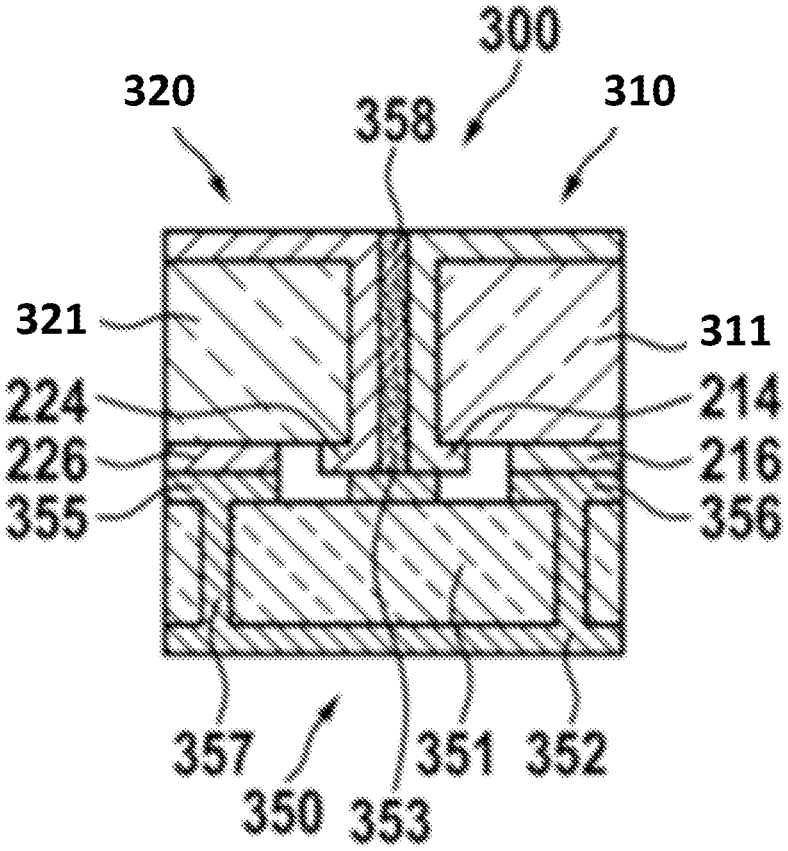
FIG. 5 shows a further waveguide structure section.

FIG. 5 shows a further waveguide structure section 300, which is basically a modification of the previous embodiment, where the fixed connector has smaller contact pads 353, which allow the first waveguide section 310 and the second waveguide section 320 to be closer to each other. Here, the waveguide sections are in direct contact with each other, such that there may be a single solder connection 358 between each of the elongate conductors.

To provide an electrical connection between the first waveguide section 310 and the second waveguide section 320, the fixed connector 350 may be soldered to these waveguide sections. For ground connection, the connector ground layers 355, 356 which are connected by at least one via 357 to the fixed connector ground base layer 352 being below the dielectric layer 351, are soldered to the ground layers 216, 226 of first and second waveguide sections. Further, the contact pad 353 is soldered to the first and second intermediate conductors 215, 225 (shown in FIG. 2), and/or to first and second contact pads 214, 224.

In the previous embodiment, there is a significant distance between the interface sections of the waveguide sections, whereas in this embodiment, the interface sections of the waveguide sections are directly connected together. This distance has an immediate influence on the characteristic impedance of the interface sections. The characteristic impedance of the interface sections may normally match to the characteristic impedance of the elongate conductors to avoid reflections and therefore signal distortions. Therefore, the distance between the interface sections may be selected such that the characteristic impedance of the connection between the interface sections matches to the characteristic impedance of the waveguide sections.

Figure 6:
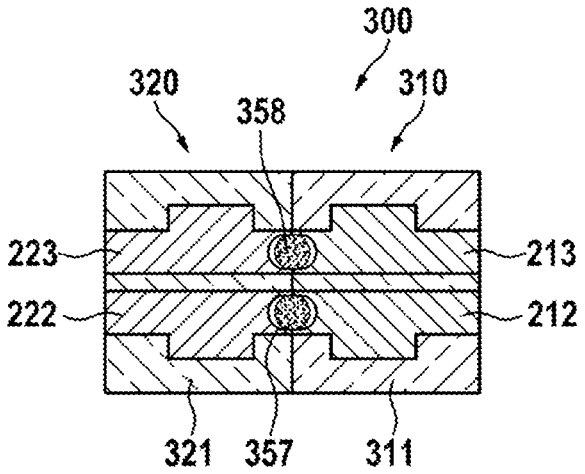
FIG. 6 shows a top view of close connected waveguide sections.

FIG. 6 shows a top view of closely connected waveguide sections as shown in the FIG. 5. Here, opposing waveguide sections 310, 320 having first and second layers 311, 321 may have a via 357 that may be filled with a common spot 358 of solder to get a direct connection.

Figure 7:
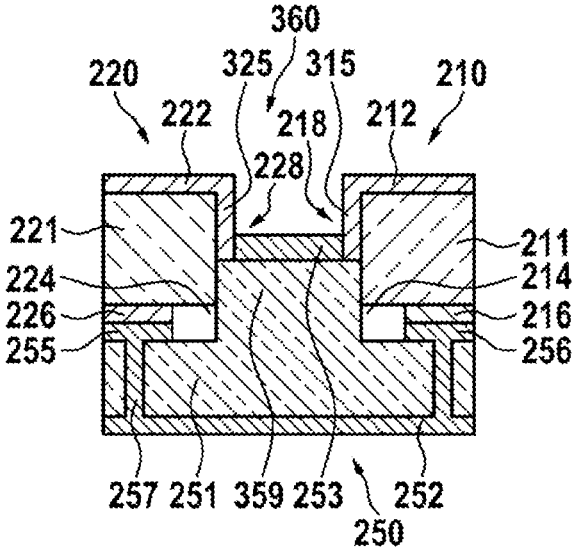
FIG. 7 shows an embodiment with a modified fixed connector dielectric layer.

FIG. 7 shows an embodiment of a waveguide structure section 360 with a modified fixed connector dielectric layer, where the fixed connector dielectric layer 251 has a protrusion 359 which shortens the electrical path between the interface sections 218, 228, and therefore provides a different characteristic impedance. To adapt to the elevated contact pad 253, the first and second intermediate conductors 315, 325 may be shortened.

Figure 8:
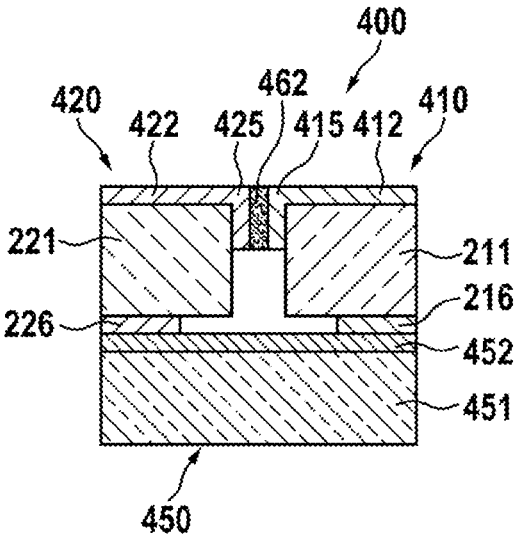
FIG. 8 shows another embodiment of a waveguide structure section.

FIG. 8 shows a waveguide structure section 400, where the contact pads are omitted. Instead, solder 462 is directly filled in-between the modified first and second intermediate conductors. As no contact pads are required, the fixed connector 450 may be simplified, such as a connector ground base layer 452 may be provided on the fixed connector dielectric layer 451. There may be only a single connector ground base layer 452. The first and second waveguide sections 410, 420 include first and second elongate conductors 412, 422 with first and second intermediate conductors 415, 425, which are adapted in their length to hold solder 462 for an electrical connection between the waveguide sections.

Figure 9:
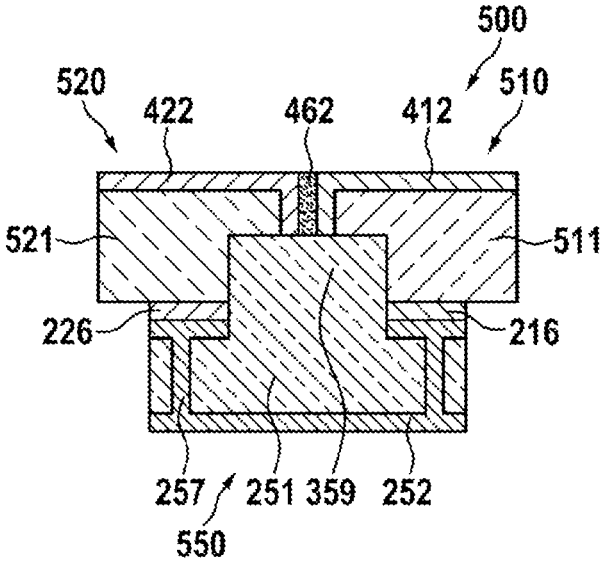
FIG. 9 shows a modification of the previous embodiment.

FIG. 9 shows a modification in a waveguide structure section 500 based on the previous embodiment, where a protrusion 359 including dielectric material of the fixed connector 550 is on the fixed connector dielectric layer 251 to support first and second waveguide sections 510, 520. The first and second waveguide sections 510, 520 have first and second layers 511, 521 of dielectric material, modified to be adapted to the protrusion 359. This embodiment results in a more robust mechanic connection and a better-defined soldering contact, as no solder may flow into the hollow space between the solder position.

Figure 10:
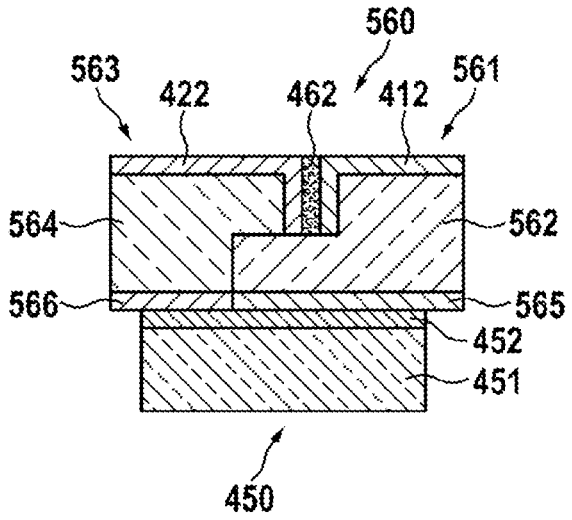
FIG. 10 discloses a further embodiment of a waveguide structure section.

FIG. 10 discloses a further embodiment of a waveguide structure section 560. A first conductor element section 561 includes a first layer of dielectric material 562 which interfaces with a second layer of dielectric material 564 of second conductor element section 563. The interface may be some overlap. A first ground layer 565 is at the bottom of the first layer of dielectric material 562, whereas a second ground layer 566 is at the bottom of the second layer of dielectric material 564. Both ground layers are connected to connector ground base layer 452.

Figure 11:
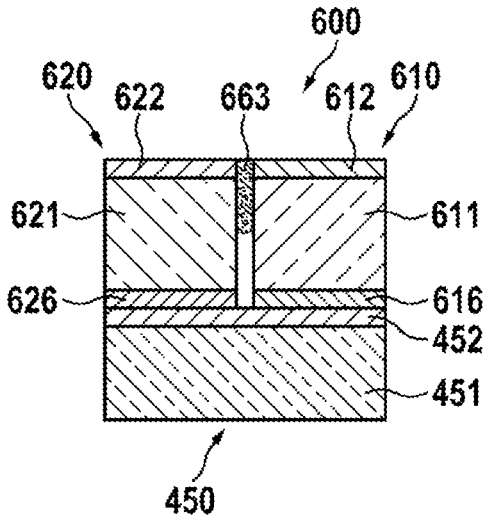
FIG. 11 shows a glued waveguide structure section.
Figure 12:
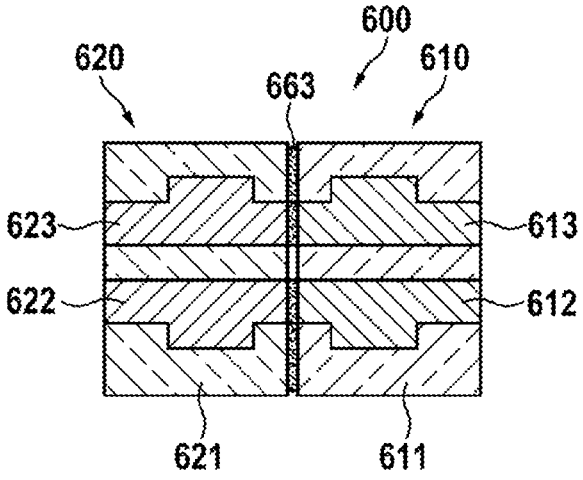
FIG. 12 shows a top view of a glued waveguide structure section.

FIG. 11 shows a glued waveguide structure section 600, while FIG. 12 shows a top view of the glued waveguide structure section 600. In reference to FIGS. 11 and 12, first and second waveguide sections 610,620 are mounted to fixed connector 450. They include first and second layers of dielectric material 611, 621 having first and second ground layers 616, 626, and first and second elongate conductors 612, 613, 622, 623. First elongate conductors 612, 613 are electrically connected to second elongate conductors 622, 623 by means of conductive glue 663 which also fills the gap partially without making a short circuit to the ground. Basically, any conductive polymer may be used. The connection between first ground layer 616, second ground layer 626 and connector ground base layer 452 may also be made by conductive glue or by soldering or welding, as mentioned above.

Referring now to FIG. 12 an optional gap between first and second elongate conductor 612, 622 as well between first and second elongate conductor 613, 623 is shown. Whether such a gap is needed, may depend on the distance between first and second waveguide section 610, 620 in relation to the distance between the individual elongate conductors, like between elongate conductor 612 and elongate conductor 613. If this distance is significantly larger than the distance between first and second waveguide section 610, 620, the resistance by the conductive glue is comparatively high with respect to the resistance between the first and second waveguide sections, and therefore may be ignored.

Figure 13:
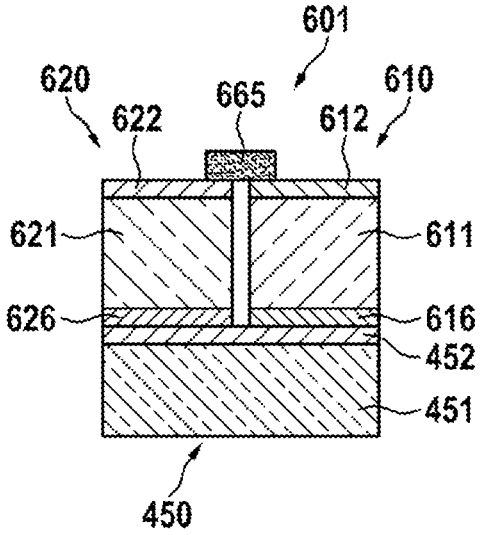
FIG. 13 shows a waveguide structure section with a conductive pad.

FIG. 13 shows a waveguide structure section 601 with a conductive pad 665. This embodiment is quite similar to the previous embodiment. But instead of a conductive glue, a conductive pad 665 or pair of conductive pads 665 is used, which is placed on top of first elongate conductor 612, 613 and second elongate conductor 622, 623, such that a first elongate conductor 612 is connected to a second elongate conductor 622, a first elongate conductor 613 is connected to a second elongate conductor 623.

Figure 14:
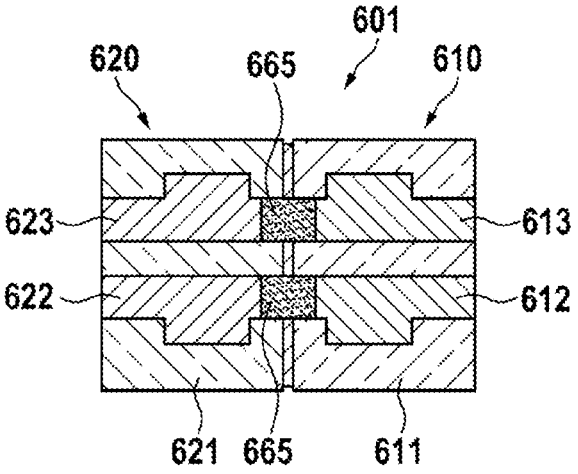
FIG. 14 shows a top view of the previous embodiment.

FIG. 14 shows a top view of the previous embodiment.

Figure 15:
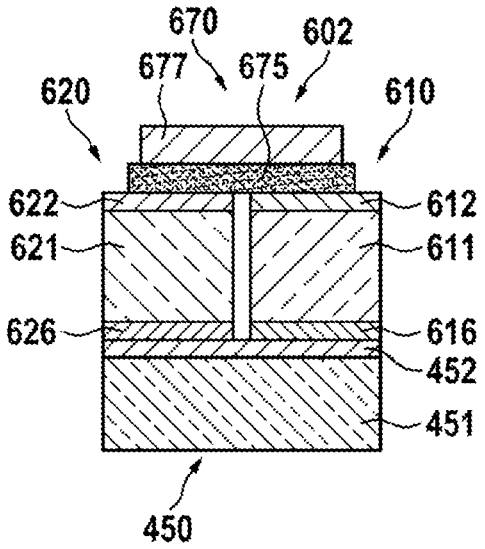
FIG. 15 shows a waveguide structure section with a connecting pad in a side view.
Figure 16:
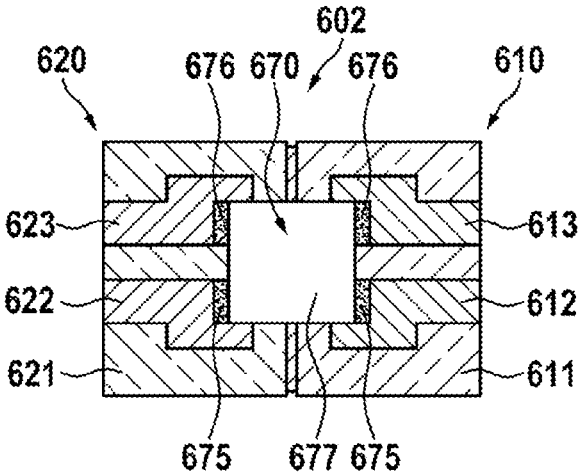
FIG. 16 shows a waveguide structure section with a connecting pad in a top view.

FIG. 15 shows a waveguide structure section 602 with a connecting pad 670 in a side view. The connecting pad 670 may include a base 677 which may further hold at least one conductive pad 675. If multiple conductors or pairs of conductors have to be connected between a first waveguide section 610 and a second waveguide section 620, then multiple conductive pads 675, 676 (as shown in FIG. 16) may be held by the base 677 at a correct position and in the correct distance to each other. Therefore, multiple conductors may be connected in a single processing step by attaching the connecting pad 670 with conductive pads 675, 676 to the waveguide sections 610, 620, e.g., by a soldering, welding or gluing connection. This simplifies alignment and reduces alignment errors. The fixed connector 450 may include a ground base layer 452 which may be provided on a fixed connector dielectric layer 451. The base 677 may include any insulating material e.g., polytetrafluorethylene or polyimide or any other plastic material. It may have a thickness of less than 1 mm, 0.2 mm, 0.1 mm or 0.05 mm. It may also be fiber reinforced. The base 677 may overlap the conductive pads 675, 676 to the sides and/or to the length of the elongate conductors. The overlapping sections may be glued and/or molded to the underlying waveguide sections. This may strengthen the connection and may provide some strain relief together with a mechanical protection.

FIG. 16 shows a waveguide structure section 602 with a connecting pad in a top view. The conductive pad 675 connects the first elongate conductor 612 to the second elongate conductor 622. Further, the first elongate conductor 613 is connected to the second elongate conductor 623 by conductive pad 676.

Figure 17:
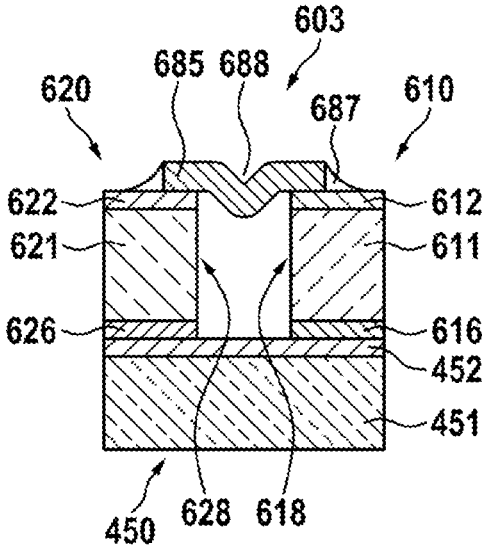
FIG. 17 shows a waveguide structure section with a flexible conductive pad in a side view.

FIG. 17 shows a waveguide structure section 603 with a flexible conductive pad 685. The flexible conductive pad 685 may have a corrugation 688, e.g., some excess length at least in a direction of the gap between the first waveguide section 610 with interface section 618 and the second waveguide section 620 with interface section 628. Connection may be made by solder, welding or glue immediately between the flexible conductive pad 685 and the waveguide sections. There may also be solder 687 applied to the outside at the ends of flexible conductor pad 685.

Figure 18:
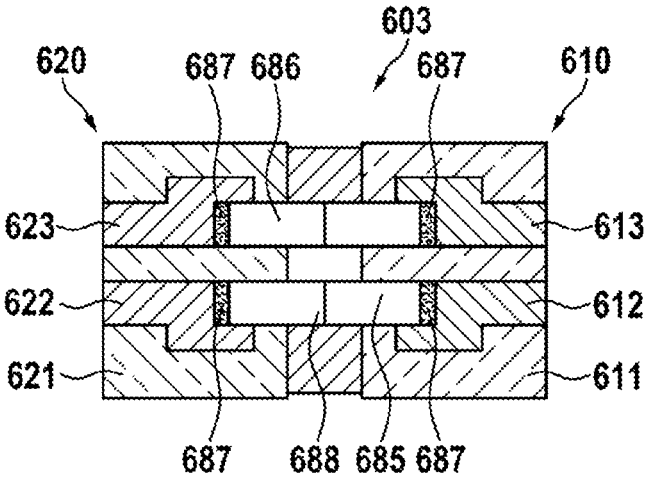
FIG. 18 shows a waveguide structure section with a flexible conductive pad in a top view.

FIG. 18 shows the waveguide structure section 603 with flexible conductive pads 685, 686 in a top view. The flexible conductive pad 685 connects the first elongate conductor 612 to the second elongate conductor 622. Further, the first elongate conductor 613 is connected to the second elongate conductor 623 by flexible conductive pad 686.

Figure 19:
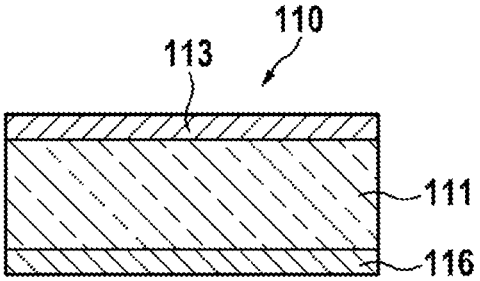
FIG. 19 shows a basic waveguide section in a side view.

FIG. 19 shows a basic waveguide section 110 in a side view. A layer of dielectric material 111 has a bottom side with a ground layer 116 and a top side opposing to the bottom side with at least one elongate conductor 113. Herein, the terms top side and bottom side are used with respect to various Figures (such as, for example, FIG. 2, FIG. 19, or FIG. 27 discussed below) to simplify locating. The embodiments shown in these various Figures may be used in any orientation, for example with top and bottom side reversed, or any other orientation.

Figure 20:
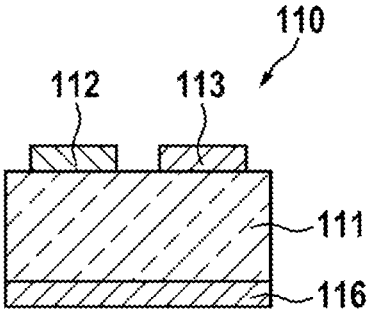
FIG. 20 shows a front view of a waveguide section.

FIG. 20 shows a front view of a waveguide section 110. Here, two elongate conductors 112, 113 are shown. There are different basic transmission line concepts using such elongate conductors. Either a single line like a microstrip line may be used to conduct or transfer signals. Alternatively, a pair of lines as shown may be used to transfer differential signals. Such a differential signal transmission has higher noise immunity. There may also be higher numbers of elongate conductors, if a higher number of signals may be transferred. Further, there may be elongate conductors having a grounding function. Such conductors may be connected to ground, for example by vias.

Figure 21:
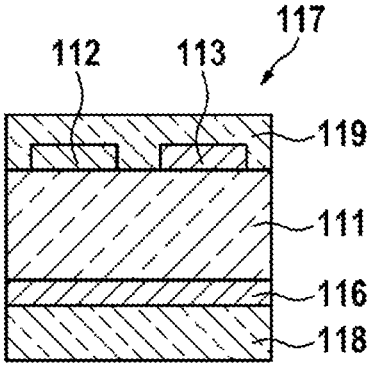
FIG. 21 shows another embodiment.

FIG. 21 shows another embodiment of a waveguide section 117, which is similar to the previous embodiment.

Here, additional layers of dielectric material 118, 119 may be provided on the bottom or may be provided at the top to enclose, protect and shield the conductive layers. This conductive copper may also include a solder stop which prevents solder flow to unwanted regions.

Figure 22:
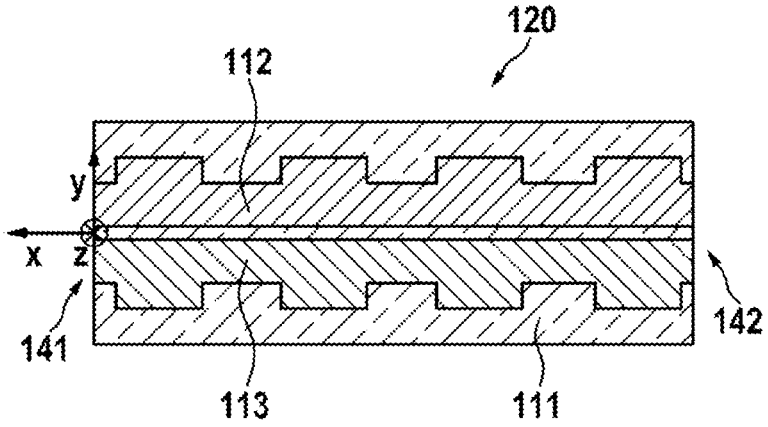
FIG. 22 shows a first embodiment of elongate conductors with a meander-shaped pattern.

FIG. 22 shows an embodiment of a waveguide section 120 having elongate conductors 112, 113 which have a specific meander-shaped pattern. Such a pattern provides a higher noise immunity compared to microstrip lines. Basically, such a waveguide section may have a first end section 141 and a second end section 142 opposing thereto. As disclosed herein, a plurality of waveguide sections is interconnected at their end sections. Further, a coordinate system is shown with an x-direction from the right side of the drawing to the left side, a y-direction from the center to the top of the drawing as shown in this Figure, and a z-direction pointing into the drawing plane.

Figure 23:
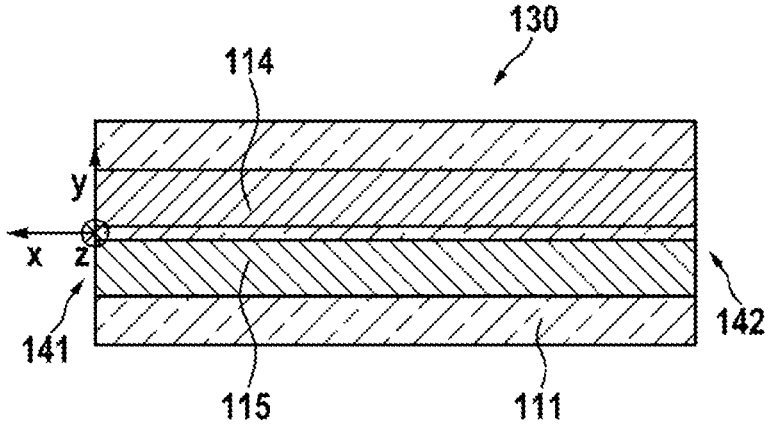
FIG. 23 shows a modified waveguide section with microstrip conductors.

FIG. 23 shows a modified waveguide section 130 with microstrip conductors 114, 115.

Figure 24:
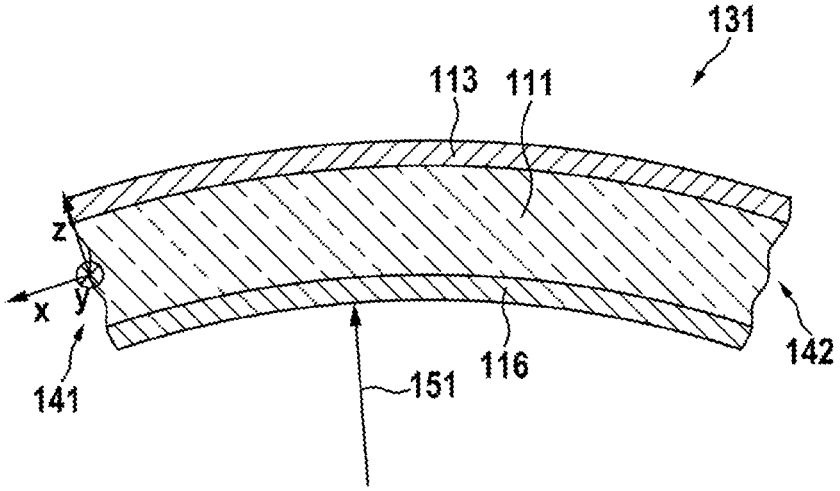
FIG. 24 shows a bent waveguide section.

FIG. 24 shows a bent waveguide section. Here, waveguide section 131 is bent with a radius 151 in an x-z-plane, such that the elongate conductors are at an outside of a cylinder shape forming by bending. In an alternate embodiment, bending may be otherwise, such that elongate conductors are at the inner side.

Figure 25:
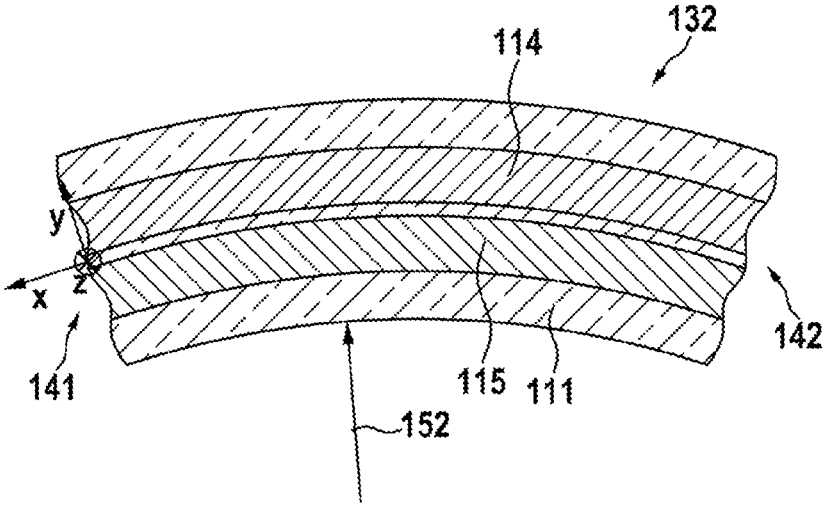
FIG. 25 shows another embodiment of a bent waveguide section.

FIG. 25 shows another embodiment of a bent waveguide section 132. Here, the waveguide section is bent on a radius 152 in an x-y-plane, forming a disk-shaped embodiment, where the elongate conductors are on one side of the disk.

Figure 26:
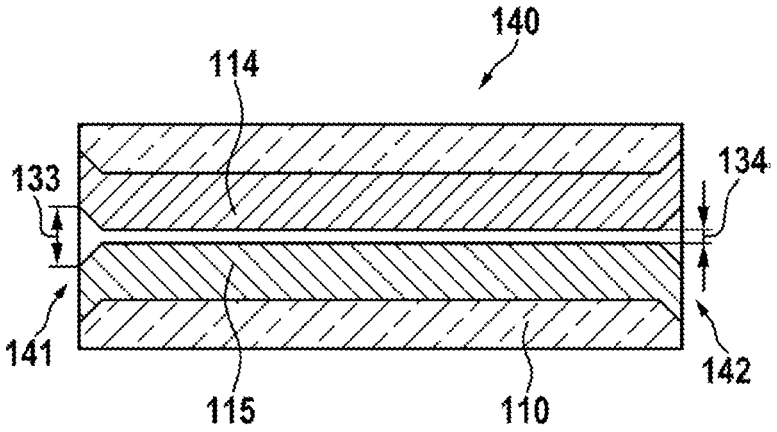
FIG. 26 shows a further waveguide section.

FIG. 26 shows a further waveguide section 140 which is similar to waveguide section 130 of FIG. 23. Here, the elongate conductors 114, 115 are slightly bent, such that the distance 133 between the elongate conductors 114, 115 at the end sections 141, 142 is larger than the distance 134 between the elongate conductors 114, 115 and outside the bent ends. This distance 134 is also referred to as the "first distance" in this document. The increased distance helps to keep the capacitance of the conductors constant, even if connecting means (such as intermediate conductors 215, shown in FIG. 2) are used. For comparison, instead of the average distance between the elongate conductors, the distance of the elongate conductors between the end sections, but without considering the end sections may be used. The first distance 134 can only be defined by a waveguide section having at least and preferably exactly two elongate conductors 114, 115.

Figure 27:
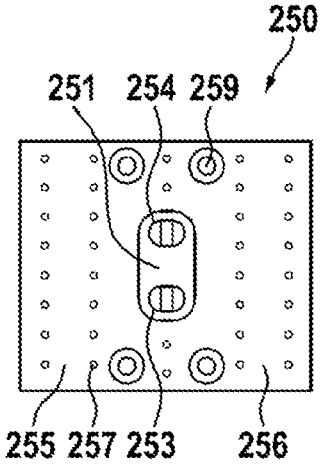
FIG. 27 shows a fixed connector.

FIG. 27 shows a fixed connector 250. It includes a fixed connector dielectric layer 251 which has connector ground layer sections 255, 256. The sections of the connector ground layer 255, 256 are electrically connected (for example by a connector ground base layer 252 shown in FIG. 2) at the bottom side of the fixed connector dielectric layer and by additional vias or through-holes 257. A further connection may be at the sides close to the screw holes 259. Further, the fixed connector further includes at least one contact pad 253, 254 on which is electrically insulated from the ground layer. There may be screw holes 259 for additional screws to hold attached waveguide sections or to hold the fixed connector to a body.

Alternatively, the holes 259 may be used to enforce the mounting of a waveguide section to the fixed connector 250 by inserting and compressing rivets.

All embodiments of lines, waveguides, waveguide sections and fixed connectors may be combined.

LIST OF REFERENCE NUMERALS

100 waveguide structure
110 waveguide section
111 layer of dielectric material
112, 113 elongate conductors
114, 115 elongate conductors as microstrip conductors
116 ground layer
117 waveguide section
118, 119 layer of dielectric material
120 waveguide section
130 waveguide section
131 waveguide section
132 waveguide section
133 distance between elongate conductors at end section
134 first distance between elongate conductors
140 waveguide section
141 first end section
142 second end section
151 radius in x-z plane
152 radius in x-y plane
200 waveguide structure section
210 first waveguide section
211, 311 first layer of dielectric material
212, 213 first elongate conductors
214 first contact pad
215 first intermediate conductor
216 first ground layer
218 first interface section
220 second waveguide section
221, 321 second layer of dielectric material
222, 223 second elongate conductors
224 second contact pad
225 second intermediate conductor
226 second ground layer
228 second interface section
250 fixed connector
251 fixed connector dielectric layer
252 connector ground base layer
253, 254 contact pads
255, 256 connector ground layer
257 via, trough hole
258 solder spots
259 screw holes
300 further waveguide structure section
310 first waveguide section
315 shortened first intermediate conductor
320 second waveguide section
325 shortened second intermediate conductor
350 modified fixed connector
351 fixed connector dielectric layer
352 connector ground base layer
353 contact pad
355, 356 connector ground layer
357 via, trough hole
358 solder spots
359 protrusion
360 waveguide structure section
400 waveguide structure section
410 first waveguide section
412 first elongate conductors
415 first intermediate conductor
420 second waveguide section
422 second elongate conductors
425 second intermediate conductor
450 fixed connector
451 fixed connector dielectric layer
452 connector ground base layer
462 solder
500 waveguide structure section
510 first conductor element section

511 first layer of dielectric material
520 second conductor element section
521 second layer of dielectric material
550 fixed connector
560 waveguide structure section
561 first conductor element section
562 first layer of dielectric material
563 second conductor element section
564 second layer of dielectric material
565 first ground layer
566 second ground layer
600 glued waveguide structure section
601 waveguide structure section with conductive pad
602 waveguide structure section with connecting pad
603 waveguide structure section with flexible conductive pad
610 first waveguide section
611 first layer of dielectric material
612, 613 first elongate conductors
616 first ground layer
618 first interface section
620 second waveguide section
621 second layer of dielectric material
622, 623 second elongate conductors
626 second ground layer
628 second interface section
663 conductive glue
665 conductive pad
670 connecting pad
675, 676 conductive pads
677 base
685, 686 flexible conductive pads
687 solder
688 corrugation
710, 720, 730, 740, 750 waveguide sections
715, 725, 735, 745 fixed connectors
761, 762 terminations
765 signal connector

The invention claimed is:

1. A waveguide structure comprising:

at least one first waveguide section mechanically and electrically connected by at least one fixed connector to at least one second waveguide section, wherein each of the at least one first waveguide section and the at least one second waveguide section comprises:

at least one layer of a first dielectric material having respective first layer top side, first layer bottom side, and two first layer opposing ends, a ground layer of a corresponding first electrically conductive material on the first layer bottom side, at least one conductor structure including a pair of elongated conductors of a corresponding second electrically conductive material on the first layer top side, the at least one conductor structure being insulated from the ground layer, and an interface section at at least one of the two first layer opposing ends;

wherein the at least one fixed connector comprises:

at least one layer of a second dielectric material having respective second layer top side, second layer bottom side, and two second layer opposing ends, at least one pair of contact pads of a corresponding third electrically conductive material on the top side, and a connector ground layer of a corresponding fourth electrically conductive material on the second layer top side and insulated from the at least one pair of contact pads, wherein the at least one fixed connector is attached by a top side thereof to a bottom side of an interface section of a first end of the at least one first waveguide section, having a respectively corresponding electrical contact between the connector ground layer and a ground layer of the at least one first waveguide section, to the bottom side of an interface section of a second end of the at least one second waveguide section, having a respectively corresponding electrical contact between the connector ground layer and a ground layer of the at least one second waveguide section, wherein:

each of the interface sections of the at least one first waveguide section and the at least one second waveguide section comprises a corresponding intermediate conductor extending from each of elongated conductors at the first layer top side to the first layer bottom side of the at least one layer of the first dielectric material, each of said corresponding intermediate conductors is connected to one of the at least one pair of contact pads and insulated from the corresponding ground layer of the at least one of the first waveguide section and the at least one second waveguide section, the at least one first and the at least one second waveguide sections are opposing each other and at least one intermediate conductor of the first waveguide section is connected to a corresponding intermediate conductor of the opposing second waveguide section by the at least one pair of contact pads.

2. A waveguide structure according to claim 1, wherein one of the at least one pair of contact pads of the at least one fixed connector is connected to an intermediate conductor, of corresponding intermediate conductors of the interface sections of the at least one first waveguide section and the at least one second waveguide section, by at least one of soldering connections, welding connections, a conductive adhesive, or a galvanized contact.

3. A waveguide structure according to claim 1, wherein the at least one conductor structure and/or at least one of ground layers of the waveguide structure includes a thin copper layer galvanized with a high conductivity material.

4. A waveguide structure according to claim 1, wherein the connector ground layer of the at least one fixed connector is connected to the at least one ground layer of at least one of the first and second waveguide sections by at least one of soldering connections, welding connections, conductive adhesive, or galvanized contact.

5. A waveguide structure according to claim 1, wherein the at least one first waveguide section and the at least one second waveguide section has a shape of a rectangular plate or arc shaped plate.

6. A waveguide structure according to claim 1, wherein the at least one conductor structure includes uniform lines having a predetermined impedance, structured pattern lines configured to have a filtering characteristic.

7. A waveguide structure according to claim 1, wherein the at least one conductor structure and/or at least one of ground layers of the at least one of the first and second waveguide sections includes a thin copper layer galvanized with a high conductivity material.

8. A waveguide structure according to claim 7, wherein the high conductivity material is silver and/or gold.

9. A waveguide structure according to claim 1, wherein elongated conductors of the pair of elongated conductors are parallel to one another and spaced with a first distance.

10. A waveguide structure according to claim 9, wherein a distance between the two intermediate conductors is larger than the first distance.

11. A waveguide structure according to claim 9, wherein the pair of elongated conductors are separated by a second distance at the interface sections of the first and second ends, the second distance being larger than the first distance.

12. A waveguide structure according to claim 1, wherein one of the at least one pair of contact pads of the at least one fixed connector is connected to an intermediate conductor, of corresponding intermediate conductors of the interface sections of the at least one first waveguide section and the at least one second waveguide section, by at least one of soldering connections, welding connections, a conductive adhesive, or a galvanized contact.

13. A waveguide structure according to claim 1, the at least one first waveguide section and/or the at least one second waveguide section includes at least one printed circuit board.

14. A waveguide structure according to claim 1, wherein the at least one fixed connector includes at least one printed circuit board.

15. A waveguide structure according to claim 1, wherein the connector ground layer of the at least one fixed connector is connected to the at least one ground layer of at least one of the first and second waveguide sections by at least one of soldering connections, welding connections, conductive adhesive, or galvanized contact.

16. A waveguide structure comprising:

at least one first waveguide section mechanically and electrically connected by at least one fixed connector to at least one second waveguide section, wherein each of the at least one first waveguide section and the at least one second waveguide section comprises:

at least one layer of a first dielectric material having a first layer top side, a first layer bottom side, and two first layer opposing ends, a ground layer of corresponding first electrically conductive material on the first layer bottom side, at least one conductor structure including a pair of elongated conductors of a corresponding second electrically conductive material on the first layer top side, the at least one conductor structure being insulated from the ground layer, and an interface section at at least one of the two first layer opposing ends, wherein the at least one fixed connector comprises:

at least one layer of a second layer dielectric material having a second layer top side, a second layer bottom side, and two second layer opposing ends, and a connector ground layer, wherein the at least one fixed connector is attached by a top side thereof to a bottom side of an interface section of a first end of the at least one first waveguide section, having a respectively corresponding electrical contact between the connector ground layer and a ground layer of the at least one first waveguide section, to a bottom side of an interface section of a second end of the at least one second waveguide section, having a respectively corresponding electrical contact between the connector ground layer and a ground layer of the at least one second waveguide section, wherein:

the interface sections of the at least one first waveguide section and the at least one second waveguide section are connected by a pair of conductive pads, wherein each of the conductive pads of said pair connects each of a pair of elongated conductors of the at least one first waveguide section to each of the corresponding of the elongated conductors of the at least one second waveguide section.

17. A waveguide structure according to claim 16, wherein the at least one conductor structure includes uniform lines having a predetermined impedance, structured pattern lines configured to have a filtering characteristic.

18. A waveguide structure according to claim 16, wherein elongated conductors of the pair of elongated conductors are parallel to one another and spaced with a first distance.

19. A waveguide structure according to claim 16, wherein the at least one first waveguide section and the at least one second waveguide section has a shape of a rectangular plate or arc shaped plate.

20. A waveguide structure according to claim 16, wherein at least one of the conductive pads of the pair of conductive pads forms a corrugation between the at least one first waveguide section and the at least one second waveguide section.

21. A waveguide structure according to claim 16, wherein the interface sections of the at least one first waveguide section and the at least one second waveguide section are straight cut ends of the corresponding at least one of the first and second waveguide sections.

* * * * *